United States Patent [19]

Gaylord

[11] 4,266,529

[45] May 12, 1981

[54] KITCHEN VENTILATOR WITH REMOVABLE GREASE EXTRACTOR

[75] Inventor: Edson C. Gaylord, Wilsonville, Oreg.

[73] Assignee: Gaylord Industries, Inc., Wilsonville, Oreg.

[21] Appl. No.: 74,889

[22] Filed: Sep. 12, 1979

[51] Int. Cl.[3] ..... F24C 15/20

[52] U.S. Cl. ..... 126/299 D; 55/DIG. 36

[58] Field of Search ..... 126/299 R, 299 D, 299 E; 55/DIG. 36; 98/115 R

[56] References Cited

U.S. PATENT DOCUMENTS

| | | | |
|---|---|---|---|
| 2,364,664 | 1/1968 | Doane | 126/299 D |
| 2,392,038 | 1/1946 | Gaylord | 126/299 D |
| 2,748,688 | 6/1956 | Smith | 126/299 D |
| 2,813,477 | 11/1957 | Gaylord | 126/299 E |
| 3,433,146 | 3/1969 | Russell | 126/299 E |
| 3,667,371 | 6/1972 | Russell | 126/299 E |
| 3,854,388 | 12/1974 | King | 126/299 E |
| 3,893,831 | 7/1975 | Doane | 126/299 E |
| 3,945,812 | 3/1976 | Doane | 126/299 D X |
| 4,072,143 | 2/1978 | Gaylord | 126/299 D |
| 4,103,676 | 8/1978 | Kastner | 126/299 E |

*Primary Examiner*—Albert J. Makay
*Assistant Examiner*—Harold Joyce
*Attorney, Agent, or Firm*—Lee R. Schermerhorn

[57] ABSTRACT

All the grease extracting baffles are incorporated in a single unit which is removable from the ventilator for cleaning. The baffle arrangement changes the direction of the whole flow of air through the ventilator without dividing the flow, as distinguished from removable grease extractors having a large number of narrow, zigzag baffles with narrow air slots between them and mounted in a frame similar to a porous filter frame.

1 Claim, 5 Drawing Figures

KITCHEN VENTILATOR WITH REMOVABLE GREASE EXTRACTOR

BACKGROUND OF THE INVENTION

This invention relates to a kitchen ventilator having a removable grease extractor of the baffle type which abruptly changes the direction of flow of a stream of contaminated air to extract grease, dust and lint particles by centrifugal force, as distinguished from a porous filter type extractor.

It is common practice to make porous filter type grease extractors removable for cleaning but such devices have a very low effeciency in comparison with baffle type extractors, with respect to their effectiveness in removing grease and other contaminants from an air flow in a kitchen ventilator associated with cooking equipment in a restaurant. There are also hybrid types which have been made removable, having a multitude of small, angular baffles which divide the air stream into parallel zigzag paths for a short distance. These baffles are mounted in shallow frames resembling filter frames.

On the other hand it has been the practice heretofore to provide spray nozzles in the ventilator for cleaning the baffle plates in a baffle type grease extractor where the direction of the whole flow of contaminated air is abruptly changed repeatedly over a considerable distance for extraction by centrifugal force. Such nozzles are supplied with hot water and detergent to clean off the grease while the baffles remain in their normal operative positions within the ventilator.

Such nozzles are also usually used for fire extinguishing purposes and complicated control systems are necessary to schedule washing and drying cycles, including control of the ventilating fan, and the fire extinguishing system. Means must be provided for disposal of the spray water. Hence baffle type grease extractors, which change the direction of the whole flow of air over a considerable distance of travel, though far superior to porous filter type extractors and the hybrid types, have become very complicated and expensive.

Although baffle type grease extractors have been made with some of the baffles removable, other baffles then remain in their fixed positions in the ventilator and must be cleaned in such positions by one means or another. For cleaning purposes there is no advantage in being able to remove some of the baffles if they cannot all be removed.

Thus there is a need, particularly in small restaurants, for a less complicated and expensive kitchen ventilator having a removable baffle type grease extracor which can be cleaned by hand without requiring washing nozzles and automatic washing and drying cycles controlled by numerous valves and switches.

SUMMARY OF THE INVENTION

In the present construction all the grease extracting baffles are incorporated in a unit which is bodily removable from the ventilator. The unit rests in operative position without any special latches, fittings or detachable connections and is lifted out by visible and convenient handles. It is not necessary to reach up into grease laden areas and manipulate parts which are out of sight.

The invention will be better understood and additional objects and advantages will become apparent from the following description of the preferred embodiments illustrated in the accompanying drawings. Various changes may be made in details of constructions and arrangement of parts and certain features may be used without others. All such modifications within the scope of the appended claims are included in the invention.

DESCRIPTION OF THE PREFERRED EMBODIMENTS

Figure 1:
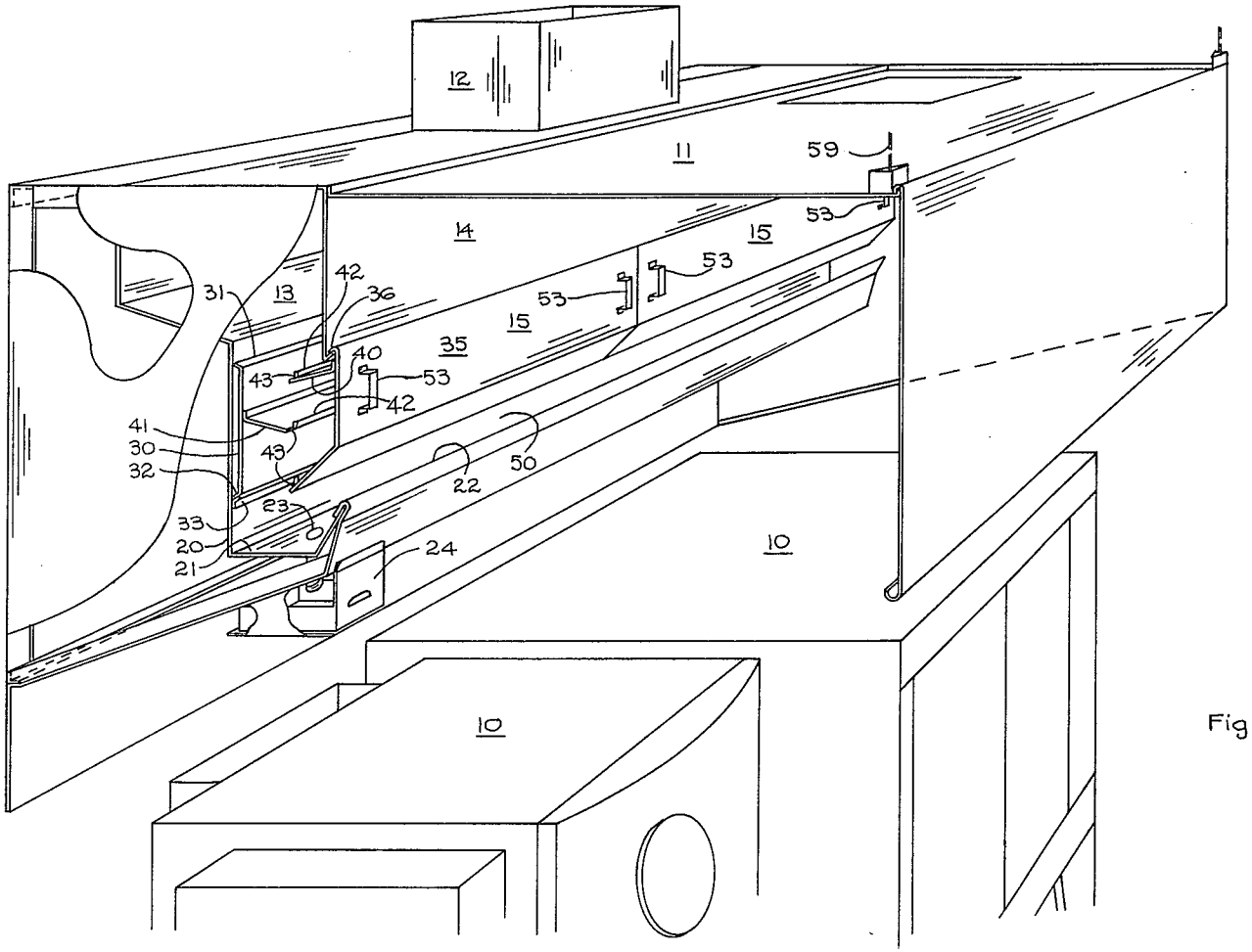
FIG. 1 is an isometric view with parts broken away showing a wall type kitchen ventilator embodying the invention.

In FIG. 1 a plurality of cooking units 10 are disposed under an overhanging hood 11. Rising above the hood 11 is a vertical exhaust duct 12 containing a suction fan and normally open fire damper, not shown. The exhaust duct 12 removes contaminated hot air rising from cooking units 10 and produces a controlled upward airflow through the grease extractor to be described.

Exhaust duct 12 draws air from a horizontally elongated chamber 13 having a front wall 14. The lower side of chamber 13 is open to draw air upward through one or more removable grease extractors 15, depending upon the horizontal length of chamber 13 which is substantially co-extensive with the cooking units 10.

Extending downward from the bottom of chamber 13 is a vertical back wall 20 which terminates in a grease trough 21. Grease trough 21 has an upper edge 22 on its front side. The grease trough slopes downward from a high end 21A (FIG. 2) to a low end having an outlet 23 discharging into a removable grease receptacle 24. Back wall 20 is usually adjacent a wall of the kitchen.

Figure 2:
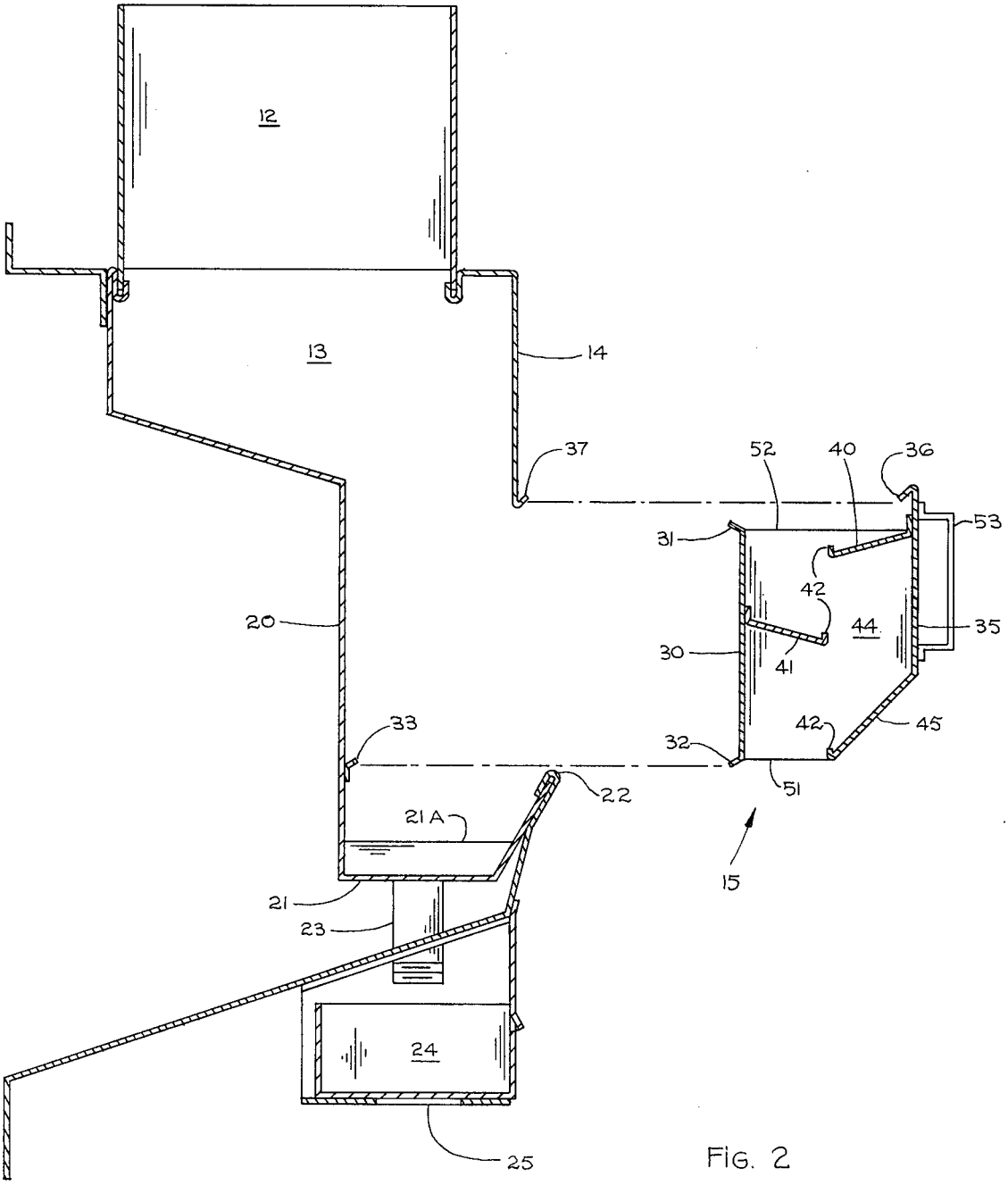
FIG. 2 is exploded cross-section view of FIG. 1 showing the grease extractor removed from the ventilator.

As best seen in FIG. 2 the grease extractor 15 has a vertical back panel 30 with a rearwardly and upwardly inclined top lip 31 to bear against back wall 20 and a rearwardly and downwardly inclined bottom lip 32 to seat on a forwardly and upwardly inclined lip 33 on back wall 20. A vertical front panel 35 has a downwardly and rearwardly inclinded lip 36 on its top edge to hang on a forwardly and upwardly inclined lip 37 on the lower edge of wall 14 as a downward extension of front wall 14.

An upper baffle plate 40 inclines rearwardly and downwardly from front wall 35 and a lower baffle plate 41 inclines forwardly and downwardly from back wall 30. Upwardly directed flanges 42 on the horizontal lower edges of these baffles form grease troughs to prevent extracted grease from dripping into the air stream at random points along the horizontal length of the baffles. Flanges 42 terminate adjacent the opposite ends of the baffles to provide drain outlets 43 adjacent the opposite end plates 44 of the grease extractor 15 where descending drops of grease are less subject to recapture by the upward air flow adjacent the end plates 44.

The lower portion 45 of front panel 35 of grease extractor 15 slopes rearwardly and downwardly and terminates in an upstanding flange 42 forming a grease gutter as described above. This flange also terminates just short of end plates 44 to provide drain outlets 43 for the gutter out of the main air stream.

When grease extractor 15 is inserted in operative position the downwardly inclined panel portion 45 is spaced above the front edge 22 of the grease trough to form an elongated inlet throat opening 50 to admit contaminated air into the grease extractor. The lower side of grease extractor 15 is open at 51 to communicate with inlet throat opening 50 and the upper side is open at 52 to communicate with chamber 13. Front panel 35 is equipped with two vertically elongated handles 53 for convenient removal of the grease extractor as illustrated in FIG. 2.

Thus, the grease extractor 15 is not hidden in an almost inaccessible position within the ventilator where its existence may not be known to kitchen cleaning workers. The conspicuous location of handles 53 make it immediately quite obvious that such handles must be connected to something removable that would require attention in routine kitchen maintenance.

When grease extractor 15 is removed, the grease extracting baffles are all cleaned as a complete unit with no other grease extracting baffles remaining in the ventilator to be cleaned separately. The support of grease extractor 15 on the two lips 33 and 37 makes its removal and replacement easy and convenient without the manipulation of any fastening devices, both of these supports being clearly visible to the operator when the unit 15 is to be replaced. A very minimum of skill and training are necessary for the removal, cleaning and reinsertion of the unit.

The vertically elongated handles 53 at opposite ends of front panel 35 provide a good grasp in the two hands of the operator so that both front and rear lips 36 and 32 may be lifted off their supporting lips 37 and 33 and the extractor withdrawn in a direct straightforward movement as shown in FIG. 2 without touching any greasy part of the extractor.

As shown in FIG. 2, when the grease extractor 15 is removed for cleaning, all of the baffle surfaces and updraft passageway surfaces are exposed at the opposite ends of the grease extractor.

FIG. 2 also shows an opening 25 in the bottom of the support for the removable grease receptacle 24, directly under drain outlet pipe 23 in grease trough 21. Whenever it may be desired to wash and flush out the trough 21, receptacle 24 is removed and a drain hose is inserted through opening 25 and connected with pipe 23.

Figure 3:
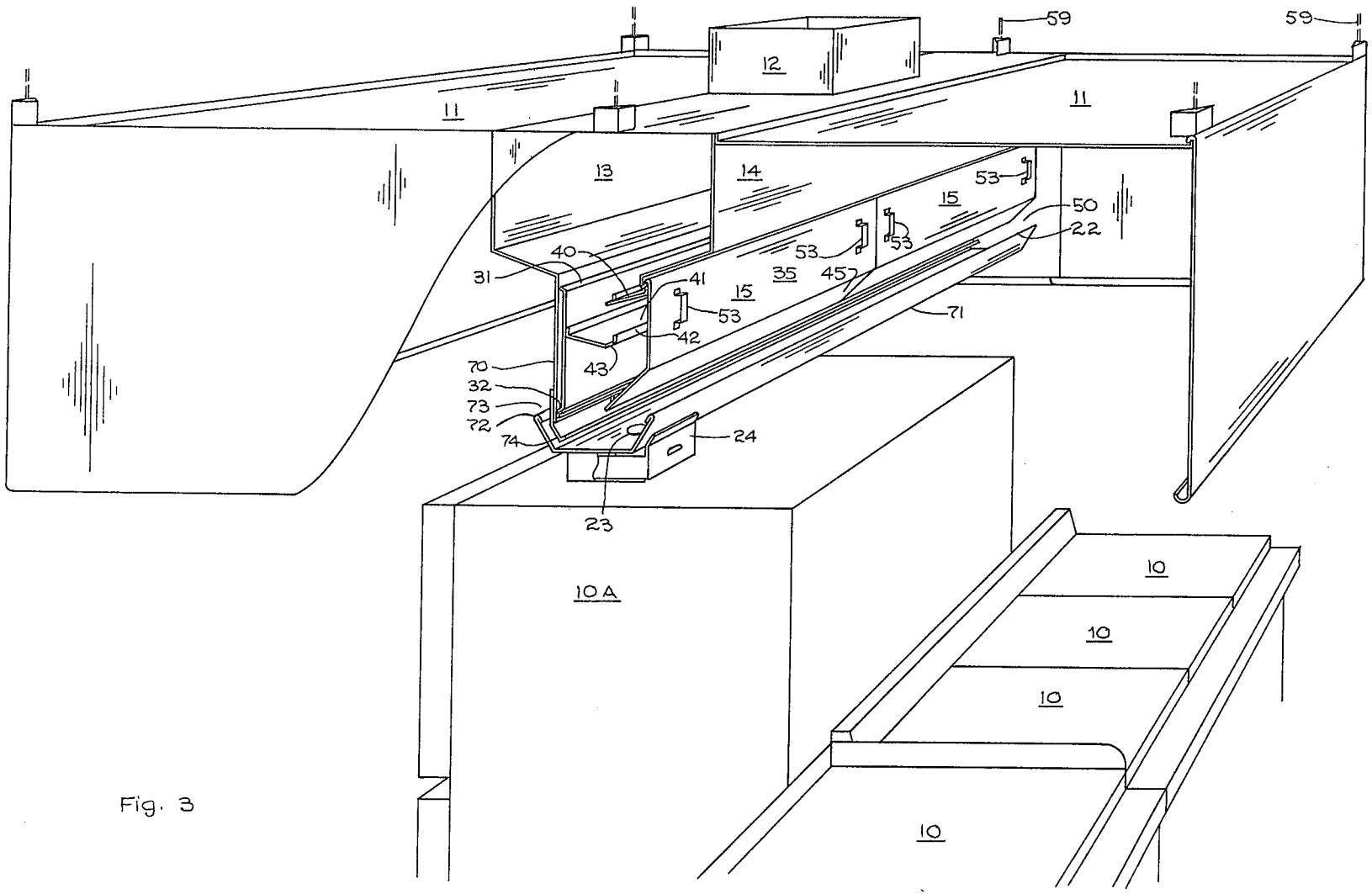
FIG. 3 is an isometric view with parts broken away showing an island type installation embodying the invention.
Figure 4:
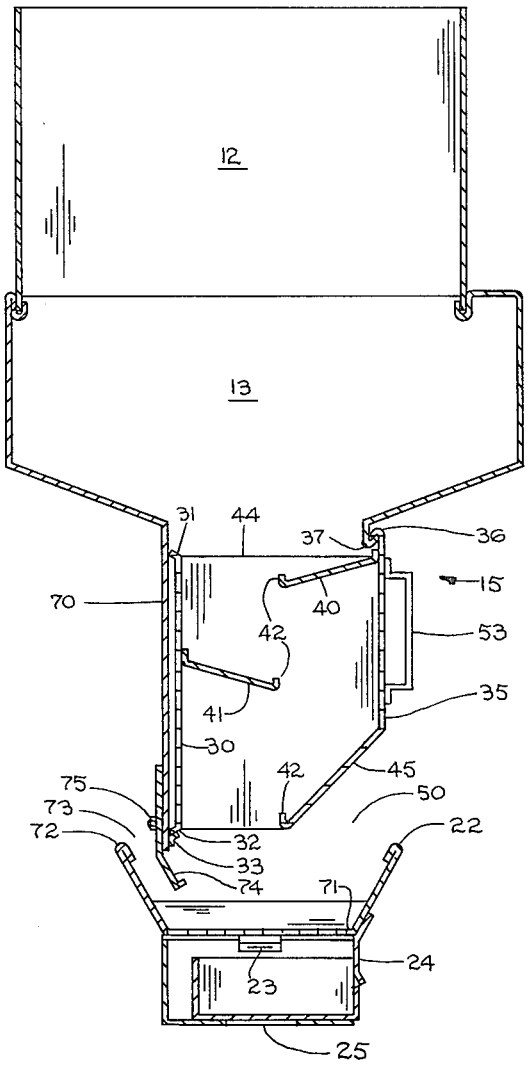
FIG. 4 is a cross-section view of the ventilator in FIG. 3.
Figure 5:
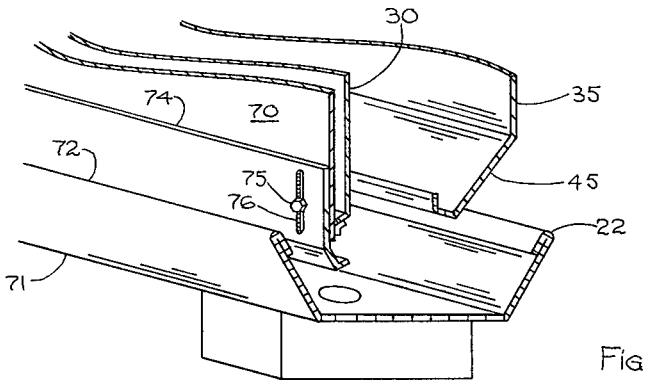
FIG. 5 is a fragmentary isometric view of the adjustable inlet throat opening in FIG. 4.

FIGS. 3–5 illustrate how the removable grease extractors 15 may be utilized in an island type installation having cooking units 10 and 10A on opposite sides of the ventilator at a distance from any wall. In such an installation the ventilator and hoods 11 are supported by hangers 59 from the ceiling or supports above the ceiling.

The lower edge of back wall 70 terminates at a distance above the grease through 71 and the grease trough has a rear upper edge 72 spaced away from back wall 70 to provide a second inlet throat opening 73. The width of throat opening 73 is adjustable by a plate 74 secured on the lower edge of back wall 70 by screws 75 in vertical slots 76.

Throat opening 73 may be closed by lowering plate 74 down to the trough 71 or the plate may be raised to provide any desired width of throat opening at 73 depending on the amount of fumes and vapors generated by the cooking units 10A. The cooking units 10A are generally less fume producing than the cooking units 10 and when the cooking units 10A are not being used the throat opening 73 is closed entirely.

What is claimed is:

1. In a kitchen ventilator having a removable grease extractor, said ventilator having a vertical back wall, a front wall and a pair of opposite side walls, a grease trough extending parallel with said back wall, and an upstanding edge on the front side of said trough at a distance below a lower end of said front wall; said grease extractor comprising a front panel having a down turned lip on its upper edge arranged to hang on an upturned lip on said lower end of said front wall of the ventilator, so that said front panel forms a downward extension of said lower end of said front wall, a pair of handles on the front side of said front panel, the lower end of said front panel being inclined rearward and downward substantially into said trough behind said upstanding edge on the trough to form an inlet throat opening for the ventilator between said trough and said front panel, a vertical rear panel on said grease extractor having a down turned lip on its lower edge supported on an upturned lip on said back wall of the ventilator, vertical end plates connected to said front and rear panels to form an updraft passageway between said panels for a flow of air from said inlet throat opening, and baffle plates projecting into said passageway from said front and rear panels arranged to change the direction of the whole flow of air through said passageway without dividing the flow, said grease extractor with said baffle plates being removable by said handles by lifting said down turned lips on said front and rear panels of the extractor off said upturned lips on said front and back walls of the ventilator, said baffle plates comprising a baffle plate projecting rearward and downward from an upper portion of said front panel, and a baffle plate on said rear panel projecting forward and downward below said first baffle plate and above said inclined lower end of said front panel, and upstanding flanges on the lower edges of said baffle plates and the lower edge of said front panel forming grease gutters extending along said lower edges, said flanges terminating at a short distance from said end plates to provide drain openings at the ends of said gutters adjacent said end plates, all the grease extracting baffles in the ventilator and all of the wall surfaces defining said updraft passageway through said baffles being contained in said removable grease extractor for removal as a unit for cleaning, and all of the baffle surfaces and updraft passageway surfaces being exposed at the opposite ends of the grease extractor when the grease extractor is removed for cleaning.

* * * * *